US006083592A

United States Patent [19]

Chich

[11] Patent Number: 6,083,592

[45] Date of Patent: Jul. 4, 2000

[54] SELF-SEALING SHINGLE ADHESIVE LOAD RELIEF

[75] Inventor: Adem Chich, Kearny, N.J.

[73] Assignee: Building Materials Corporation of America, Wayne, N.J.

[21] Appl. No.: 09/146,570

[22] Filed: Sep. 3, 1998

[51] Int. Cl.[7] ..... B32B 33/00; E04D 1/00

[52] U.S. Cl. ..... 428/40.3; 428/156; 428/161; 428/172; 52/518; 52/528; 52/553

[58] Field of Search ..... 52/506.01, 518, 52/519, 520, 528, 534, 544, 553, 558; 428/40.3, 41.8, 143, 156, 161, 172

[56] References Cited

U.S. PATENT DOCUMENTS 4,731,284 3/1988 Hailer et al. ..... 52/518
5,295,339 3/1994 Manner ..... 52/518
5,592,799 1/1997 Reinke ..... 52/529
5,860,263 1/1999 Sieling et al. ..... 52/518

*Primary Examiner*—Donald Loney
*Attorney, Agent, or Firm*—Marilyn J. Maue; William J. Davis; Walter Katz

[57] ABSTRACT

This invention relates to a self-sealing roofing member which is a shingle or siding carrying adhesive in a horizontal area extending from the leading side edge to the rear side edge of one surface of the member, the opposite surface of said member having a complementary convex channel extending from the leading side edge to the rear side edge corresponding to the adhesive area; said channel being in contact with an adhesive release material in the area corresponding to the adhesive.

10 Claims, 1 Drawing Sheet

SELF-SEALING SHINGLE ADHESIVE LOAD RELIEF

BACKGROUND OF THE INVENTION

Prior self-sealing composite and unitary roofing and siding shingles generally employ heat and/or pressure sensitive globules, dabs, stripes or bands of adhesive on their under surfaces to aid in securement between courses when shingles are installed.

After manufacture, self-sealing shingles are stored or shipped to the consumer in bundles generally comprising more than 5 units after which the bundles may be stacked and subjected to extended storage at the construction site. Adhesive materials sealing at low temperatures are relatively soft and unable to withstand loads during storage and shipping without deformation and loss of thickness due to compression. The same affect has been noted with other adhesive materials such as the pressure sensitive and higher temperature sealants, although to a lesser extent. In all cases, the loss of adhesive thickness as a result of compression seriously degrades the product performance, most particularly in wind lift resistance of the shingle and tolerable shear strain capacity in the adhesive which causes cracking and other aging problems.

Accordingly it is an object of the present invention to provide a shingle having a load relief zone which would transfer the load on the surface of the adhesive to the entire body of the shingle.

Another object of the invention is to provide a shingle capable of withstanding heavy loads without adhesive deformation.

Still another object of the invention is to achieve the above benefits without altering adhesive formulations currently in use.

Yet another object is to accomplish the above improvements by a commercially feasible and economical method of manufacture.

These and other benefits of the invention will become apparent from the following description and disclosure.

THE INVENTION

In accordance with this invention the term "surface" or "shingle surface" refers to either the top or under surface of a shingle.

This invention comprises a roofing member of self-sealing siding or roofing shingle which provides an adhesive bond between overlapping courses of said members, said member having adhesive sealant superimposed and protruding from one surface thereof and having on its reverse surface a complementary convex channel of a width, length and depth sufficient to completely cover the sealant protuberance; said channel being lined or surfaced with a sealant release material or said protuberance covered with said sealant release material.

The sealant is disposed on a shingle surface as a ¼ to 2 inch wide series of dots, dabs, globules, intermittent bands or as a continuous rib or band of equal width extending from one side of the shingle to the other. The bonding between shingle units is achieved with a temperature sensitive or pressure sensitive adhesive. The temperature sensitive adhesive is one which becomes flowable at between about 70° and about 200° F. and is preferably of the bituminous type, examples of which include petroleum resins and mixtures with asphalt, naphtha insoluble extract of wood rosin (Vinsol) and its ester derivative (Hercolyn), the polymerized product from coumarone and indene obtained from coal tar (Cumar T-3) with a solvent extract from lube oil (Indonex). While the common bituminous base adhesives are preferred, numerous other adhesives and their mixtures may be utilized, as, for example natural and synthetic resins, coal tar pitches, and any other temperature sensitive adhesive material conventionally used to bond shingles. Pressure sensitive adhesives are those which are rubber based and mixtures thereof which have a softening point between about 150° and about 260° F., examples of which include mixtures of butyl rubber with polyisobutylene, asphalt roofing flux or petroleum extract resin. However, it will be understood that any conventional pressure sensitive adhesive can be utilized as well as any combination of temperature and pressure sensitive adhesive. In general the adhesive coated on one surface of the shingle has a thickness of between about 1 to about 25 mils, preferably between about 4 and about 15 mils.

The complementary channel on the reverse surface of the shingle provides a load relief zone where the adhesive extending from the opposite surface of one shingle is nested in the channel of another in a successive course so as to eliminate any load bearing function which otherwise causes adhesive deformation and loss of adhesive thickness.

A conventional adhesive release material is also utilized in the present invention and is positioned to cover either the adhesive on one side of the shingle or to cover or line the channel on the reverse side. Suitable release materials include silicone release tape waxed paper, silicone release tape or film, and the like.

The shingles of this invention include mono- and multi ply types as in a roll on sheet used for built up roofing and also includes individual shingles of the tabbed variety which in turn includes mono-layered and composite types having a headlap portion and a tabbed portion with or without a backup strip underlaying the tabs. As contemplated by this invention flexible, self-sealing asphaltic shingles of all types are included; however these usually consist of a base felt saturated with an asphaltic bitumen or some other form of bituminous composition and have superimposed either a single layer or a plurality of layers additional bituminous compositions securely bonded to the bituminous impregnated base felt. On the weather surface of the shingle, granules resistant to weather are commonly embedded into the bituminous surface and the under surface may or may not be surfaced with talc, mica, sand and the like. Numerous modifications of the asphalt shingles are included herein which do not impact on the adhesive load relief feature of this invention. For example, the composition of the base felt may be rag, bagasse, asbestos, glass fiber or any other form of organic or inorganic felt. Similarly, the weight of such felt may be altered from a light weight felt to heavy felt depending on the preference of the consumer. Additionally, the felt can be used singly or as a plurality of such felts may be laminated together to form a unitary base felt.

SUMMARY OF THE DRAWINGS

Referring now to the drawings which illustrate preferred embodiments of the invention and in which.

DETAILED DESCRIPTION OF THE DRAWINGS

Figure 1:
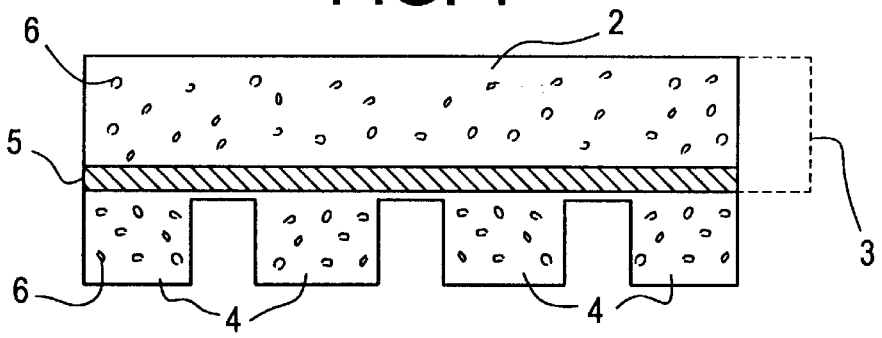
FIG. 1 is a top plan view showing the top surface of an individual tabbed shingle with the convex channel in close proximity above the tabs extending from the headlap portion.
Figure 2:
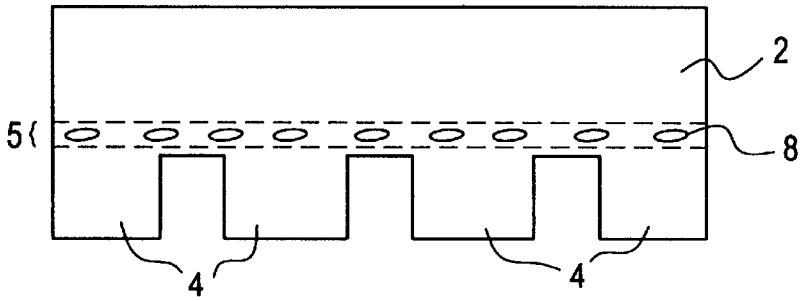
FIG. 2 illustrates a bottom plan view of the under surface of the shingle unit with the adhesive applied as dots in the area corresponding to the area of the channel in close proximity to the tabs.

FIG. 1 shows shingle 2 having weather resistant granules 6 on its top surface. Shingle 2 is divided into headlap portion 3 and tab portion 4. Adhesive load relief channel 5 is indicated by the shaded area in FIG. 1 and, in this instance, is positioned above tabs 4 in headlap portion 3 of shingle 2. FIG. 2 illustrates the under surface of the shingle of FIG. 1 where adhesive beads 8 are located in a horizontal area indicated by broken line area 5 which is complementary to the area of channel 5 in FIG. 1. As a modification of this embodiment, a continuous raised adhesive strip or strips or other adhesive configuration can replace the beads in the drawing.

Figure 3:
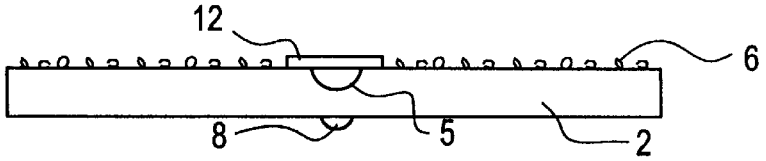
FIG. 3 is an enlarged cross-sectional view of the shingle illustrated in FIGS. 1 and 2.

The cross-sectional view in FIG. 3 illustrates the complementary positioning of adhesive bead or dot 8 with respect to channel 5. In this instance, adhesive release tape 12 is positioned to extend over channel 5; so that when depressed by the sealant, the tape forms a lining on the exposed surface of 5. However, it is within the scope of this invention to position the release tape or other release material over the adhesive beads, strip or strips instead of over channel 5.

Figure 4:
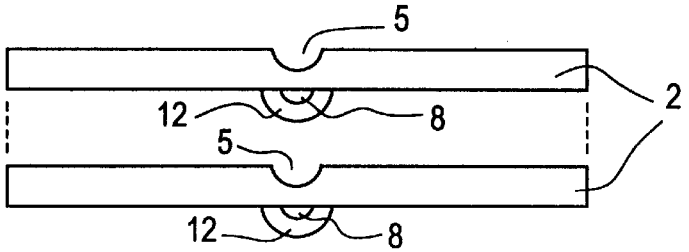
FIGS. 4 and 4(*a*) show a plurality of the present shingles prior to packing and after packing into bundles for shipment or storage.
Figure 4A:
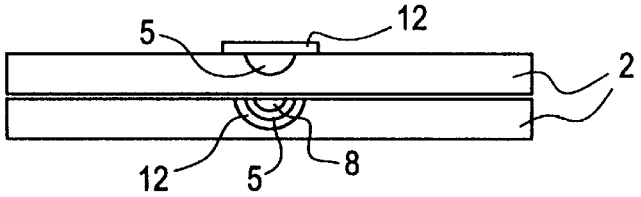

FIGS. 4 and 4(*a*) show a plurality of shingles of this invention where the adhesive 8 is nested in release tape lined channel 5 obtained by the complementary placement of adhesive and matable channel areas of this invention.

It will be recognized that many modifications and substitutions can be made in the embodiments of the drawings without departing from the scope of this invention. For example, the positioning of the adhesive and channel can be reversed so that the adhesive is located on the top surface and the complementary channel located on the under surface of the shingle. Also, the adhesive and the corresponding matable channel can be located at any area on the width of the nonexposable portion of the shingle where overlapping of courses occurs. Hence, the adhesive and corresponding channel on opposite surfaces could be located along the top margin of the shingle. Many other modifications will become apparent from the present description and disclosure.

What is claimed is:

1. A storage stable, load bearing siding or roofing shingle unit having a headlap portion and a butt portion and adapted for installation in successive courses of overlaid headlap portions which comprises an adhesive sealant material protruding from one surface of said headlap portion, a complementary convex indentation of similar width, length and depth as said protruding sealant material on the opposite surface of said headlap portion and a sealant release material covering the exposed surface of at least one of said sealant and said indentation.

2. A pair of storage stable, load bearing units of claim 1 wherein the protruding sealant on the top surface of the first unit is nested in the indentation on the bottom surface of the second unit.

3. A pair of storage stable, load bearing units of claim 1 wherein the protruding sealant on the bottom surface of the second unit is nested in the indentation on the top surface of the first unit.

4. A plurality of storage stable, load bearing units of claim 1 wherein the protruding sealant on the surface of eon unit is nested in the indentation of an adjacent unit.

5. A unit of claim 1 wherein said sealant material is covered with a sealant release material.

6. The unit of claim 1 wherein said indentation is lined with a sealant release material.

7. The unit of claim 1 wherein a continuous band of said sealant material extends from the leading end to the trailing end of the headlap portion of said unit and the indentation is a similarly extended channel on the opposite surface of said headlap portion.

8. The unit of claim 1 wherein a plurality of adhesive beads are located on one surface of said headlap portion and an equal number of indentations, in complementary location, are located on the opposite surface of said headlap portion of the unit.

9. The unit of claim 1 wherein said sealant material has a thickness of from about 1 to about 25 mils.

10. The unit of claim 9 wherein said sealant material has a thickness of from about 4 to about 15 mils.

* * * * *